United States Patent [19]

Spitz

[11] Patent Number: 4,809,371

[45] Date of Patent: Mar. 7, 1989

[54] WALL BED WITH COLLAPSIBLE TABLE

[76] Inventor: Melvin P. Spitz, 619 N. Elm Dr., Beverly Hills, Calif. 90210

[21] Appl. No.: 127,496

[22] Filed: Dec. 1, 1987

[51] Int. Cl.[4] ..... A47D 11/00; A47C 19/06

[52] U.S. Cl. ..... 5/2 R; 5/136; 5/507

[58] Field of Search ..... 5/2 R, 133, 136, 507; 108/49, 48, 134

[56] References Cited

U.S. PATENT DOCUMENTS

| | | | |
|---|---|---|---|
| 571,620 | 11/1896 | Mann | 5/2 R X |
| 1,584,139 | 5/1926 | Porter | 108/49 |
| 1,800,610 | 4/1931 | Edwards | 5/2 R |
| 1,924,732 | 8/1933 | Botright | 5/507 |

FOREIGN PATENT DOCUMENTS

| | | | |
|---|---|---|---|
| 30494 | 3/1910 | Sweden | 5/133 |
| 865234 | 4/1961 | United Kingdom | 5/507 |

*Primary Examiner*—Gary L. Smith
*Assistant Examiner*—Michael F. Trettel
*Attorney, Agent, or Firm*—Whann & Connors

[57] ABSTRACT

Disclosed is a wall bed having a support with a collapsible side table mounted to the support. The side table is movable between a folded storage position enabling the table to be retracted into the wall with the support and an extended position with the table next to the bed.

6 Claims, 3 Drawing Sheets

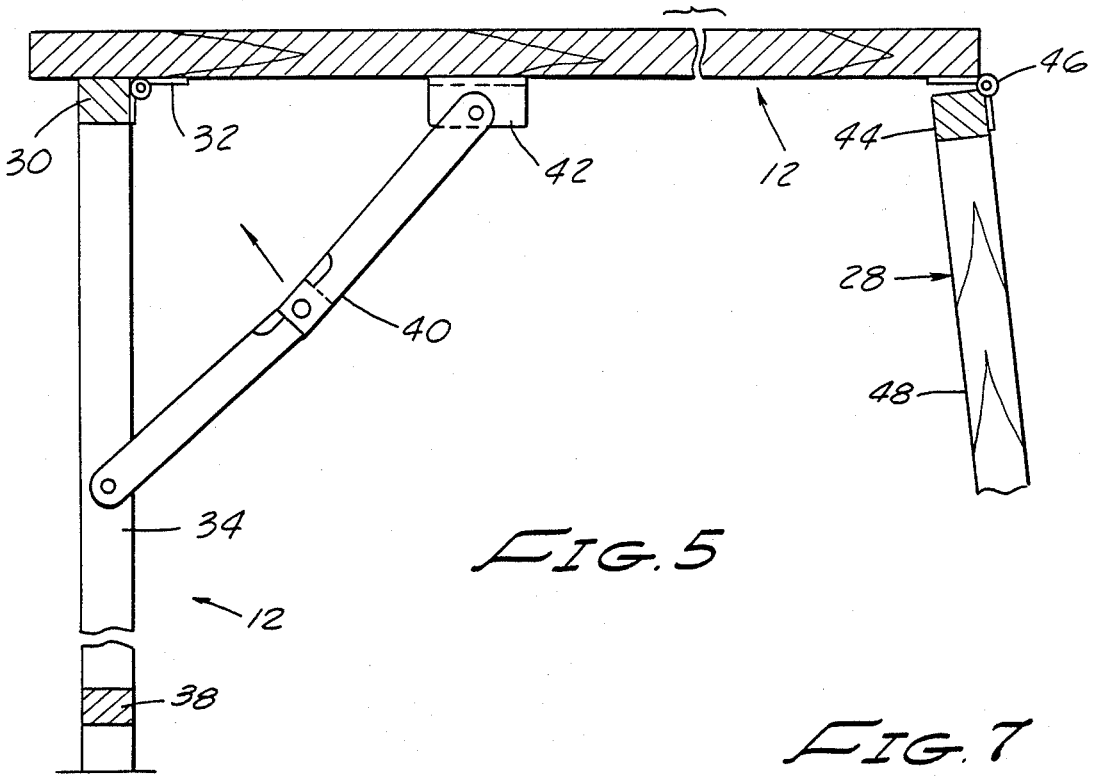
FIG. 5
FIG. 7
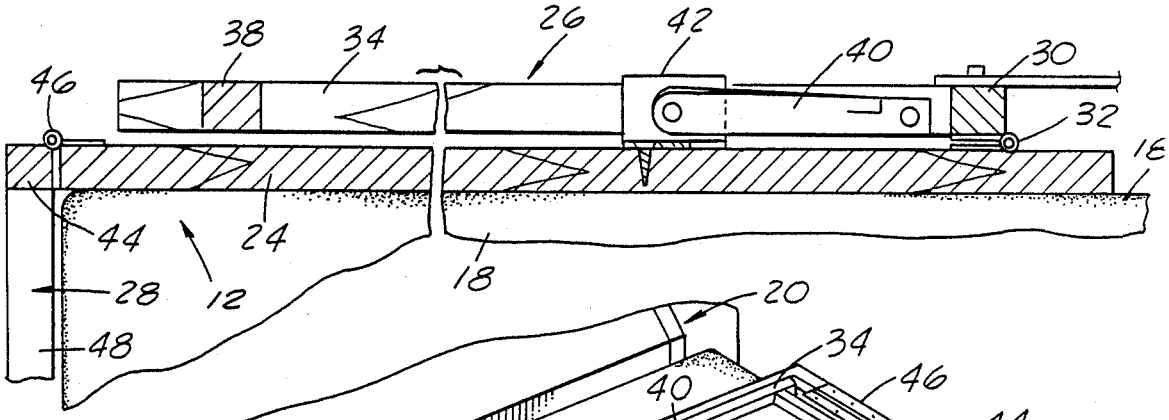
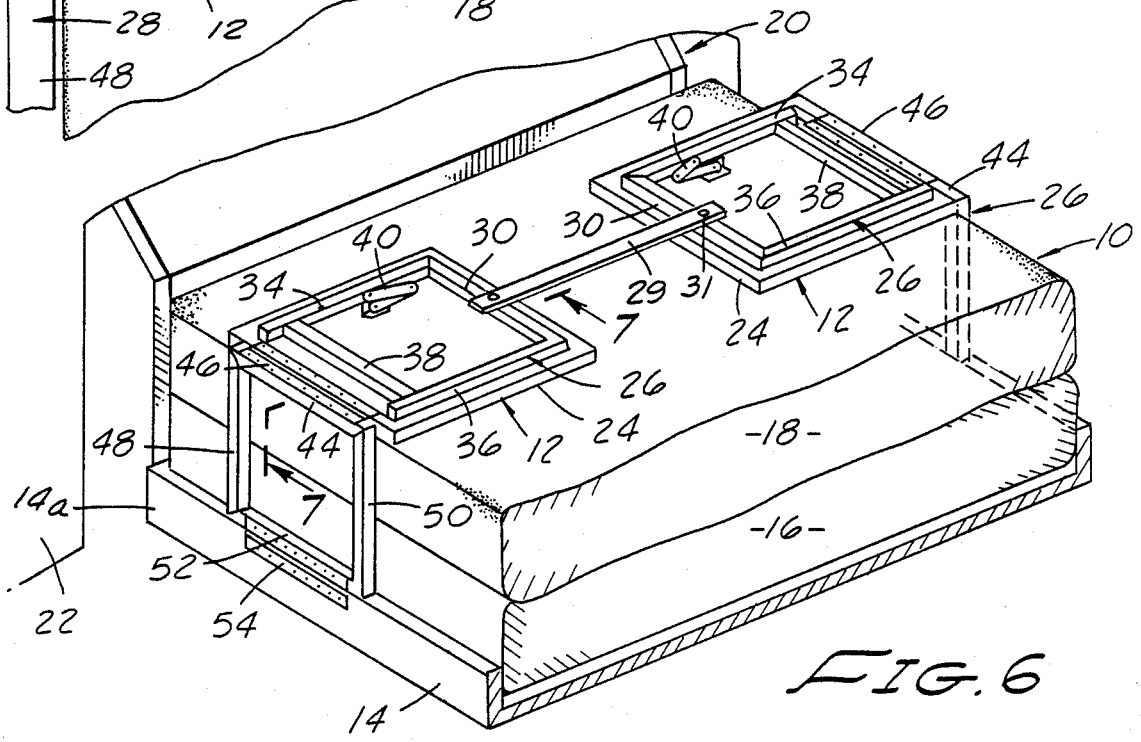
FIG. 6

WALL BED WITH COLLAPSIBLE TABLE

BACKGROUND OF THE INVENTION

1. Field of the Invention

This invention relates to a wall bed, and in particular to a wall bed having collapsible side tables mounted thereto which extend outwardly from the bed and are collapsed and folded inwardly when the bed is retracted into the wall.

2. Background Discussion

Wall beds are well known devices which include a support for a mattress and associated boxsprings. The bed extends outwardly from a wall and is retracted into a cavity in the wall for storage. Typically, the support is mounted on brackets which enable it to be tilted inwardly from one end into the wall cavity.

Wall beds are commonly employed in situations where space is at a premium, such as hotels and efficiency apartments. Generally, such wall beds do not have any associated side tables. It is the objective of this invention to equip such conventional wall beds with collapsible side tables that are mounted to fold inwardly and be retracted when the wall bed is retracted.

SUMMARY OF THE INVENTION

The wall bed of this invention includes a collapsible side table mounted to the support for the mattress and movable between a folded storage position where the table is retracted into the wall with the support and an extended position where the table is positioned next to the bed. The side table has a table top with first and second leg members attached by hinges to opposed ends of this table top. The first leg member extends downwardly to the floor on which the support rests when the bed is in the extended position. The second leg member is attached by a hinge to the support. The leg members are connected to the table top in a fashion which facilitates unfolding and folding of the table. A conventional, foldable brace is used to connect the underside of the table top to the first leg member and to hold this leg member in a downward position when the table is extending out from the side of the bed. The second leg member is connected between the table top and the support by a hinge. The first and second leg members hold the table top in a generally horizontal position when extended. The table top folds inwardly about the second leg member, with the top surface of the table top resting on the mattress. The brace upon being folded inwardly, permits the first leg member to fold downwardly to rest on the underside of the table top.

The principal feature of this invention is that it provides a convenient way of mounting and storing a table along with a retractable wall bed. The other features of this invention are discussed in the section of this application entitled "Description of the Preferred Embodiment".

BRIEF DESCRIPTION OF THE DRAWING

The drawing, where like numerals indicate like parts, depicts the preferred embodiment of this invention, in which:

FIG. 5 is a cross-sectional view taken along line 5—5 of FIG. 3.

FIG. 6 is a perspective view of the wall bed with the collapsible table of this invention, showing the table in the collapsed position so the bed can be retracted into the wall.

FIG. 7 is a cross-sectional view taken along line 7—7 of FIG. 6.

DESCRIPTION OF THE PREFERRED EMBODIMENT

Figures 1, 4:
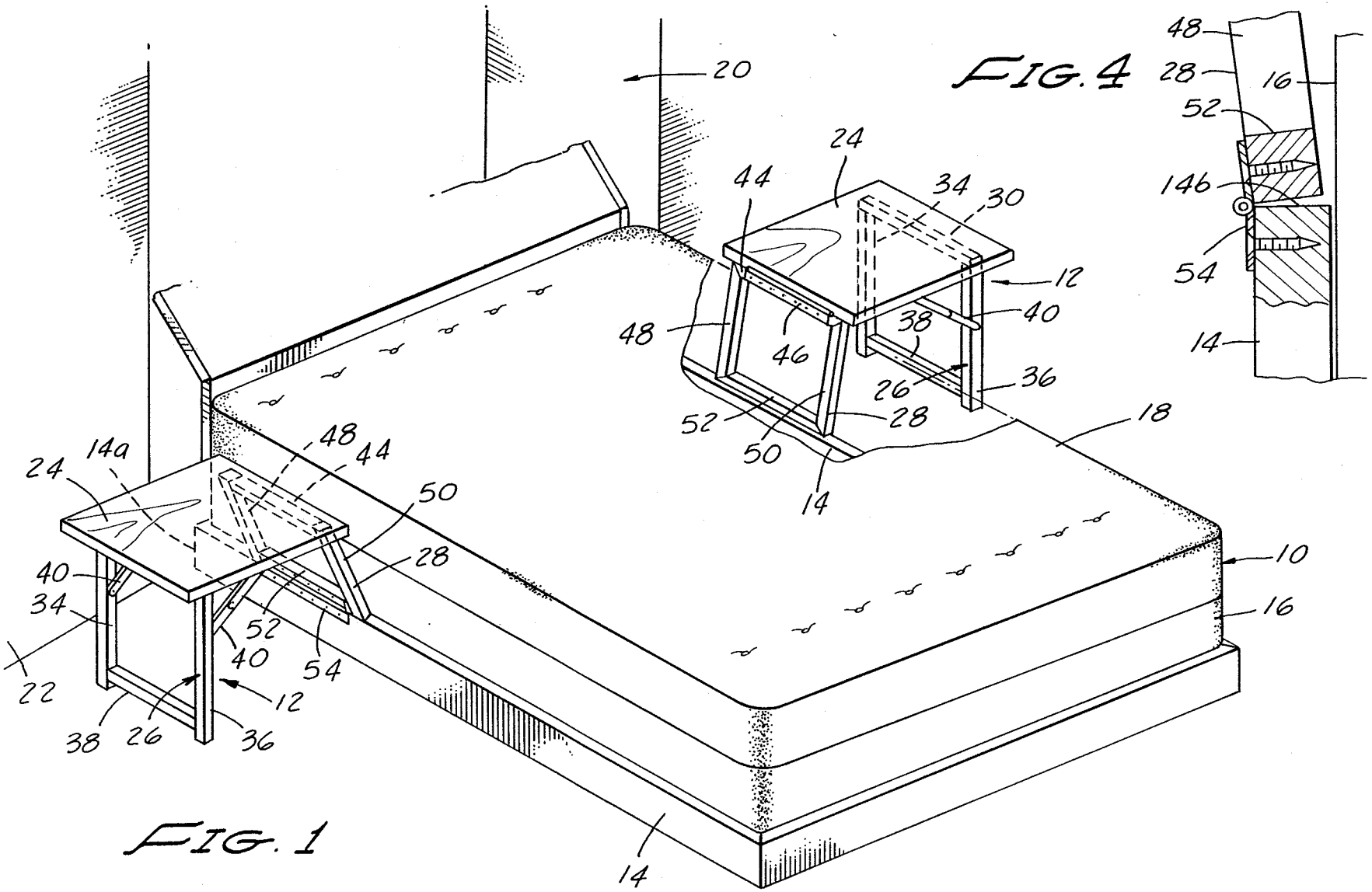
FIG. 1 is a perspective view, with sections broken away, of the wall bed with collapsible table of this invention, showing the table in an extended position.
FIG. 4 is a cross-sectional view taken along line 4—4 of FIG. 3.
Figure 2:
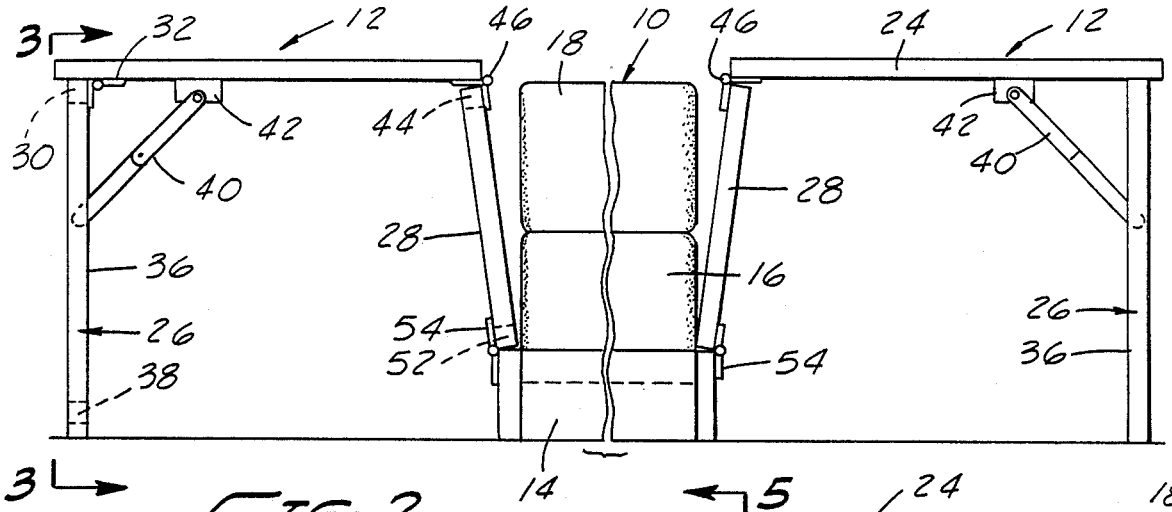
FIG. 2 is an end elevational view of the wall bed with the collapsible table of this invention.
Figure 8:
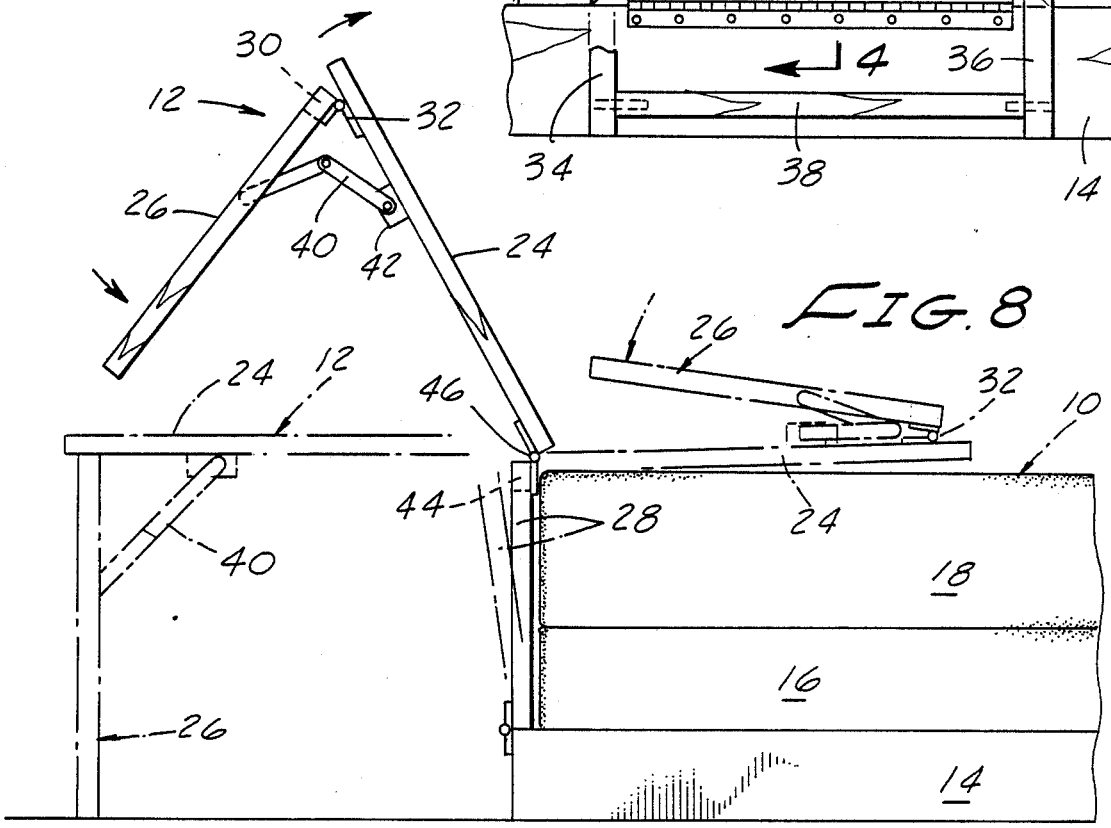
FIG. 8 is an end elevation showing the collapsible table being moved between an extended position and a collapsed position.

As illustrated in FIG. 1, a conventional wall bed 10 is shown equipped with collapsible tables 12 which, as shown in FIGS. 6 and 8, are adapted to collapse inwardly and rest on top of the bed.

The bed includes a support 14, such as a box-like wooden structure having a rectangular configuration corresponding to the rectangular configuration of a box springs 16 and mattress 18 which rest upon top of the support. The support 14 has at its rear end **14*a* a linkage system (not shown) which enables the support, with associated boxsprings and mattress, to move upwardly and inwardly into a cavity 20 in the adjacent wall. In accordance with this invention, a pair of collapsible tables 12 are mounted to the support 14 and adapted to be folded inwardly and be retracted into the wall cavity 20 when the support is folded inwardly. Each table 12 is essentially identical to the other table, with one extending from the left side of the bed, and the other extending from the right side of the bed. Although two tables 12** are shown for a double bed, only one table could be used.

Each table 12 includes a flat, generally rectangular table top 24. The surface of the table top 24 may be covered with a laminate and is preferably made of pressboard or wood. At opposed ends of the table top 24 are downwardly extending outer and inner leg members 26 and 28. The outer leg member 26 includes a leg mount 30 which consists of a generally long piece of wood which is mounted by hinges 32 to the underside of the table top. Secured to this leg mount at opposite ends are two downwardly extending legs 34 and 36 which are connected near their bottom ends by a cross bar 38 that provides support. About a quarter of the way down each leg is mounted one end of a inwardly foldable brace 40. The other end of this brace is connected by a bracket 42 (FIG. 5) to the underside of the table. When the brace 40 is pushed outwardly, as shown in FIG. 5, it supports the leg member 26 in an outwardly extended position so that the leg member is generally at a right angle to the table top. When the bracket is folded inwardly, as shown in FIG. 8, the leg member 26 moves inwardly, pivoting about the hinge 32 to move towards the underside of the table top 24.

Figure 3:
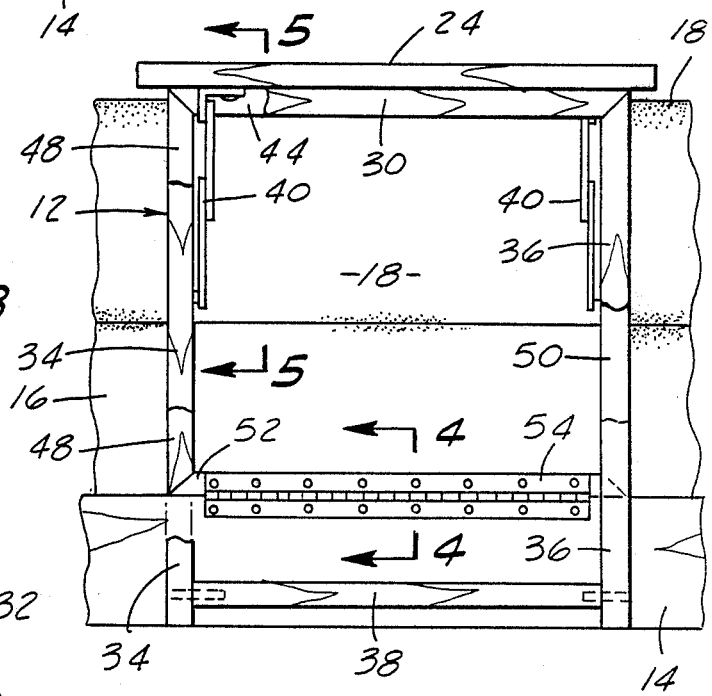
FIG. 3 is a cross-sectional view taken along line 3—3 of FIG. 2.

The inner leg member 28 includes a leg mount 44 which is secured to the underside of the table by a hinge 46 that allows the table top to pivot in a clockwise direction, as viewed in FIG. 5, about this hinge. This leg member 28 also includes two downwardly extending legs 48 and 50 which have a cross bar 52 connected to them as shown in FIGS. 3 and 6. As best shown in FIG.

4, a hinge 54 secures the cross bar 52 to the support 14 adjacent the side of the bed. The bottom surface of the cross bar 52 rests against the top edge 14*b* of the support 14 so that the leg member 28 is flush with the surface of the support when the table 12 is collapsed. When the table 12 is folded inwardly, the inner leg member 28 moves towards the sides of the boxsprings 16 and mattress 18, as shown in FIG. 8, permitting the table top 24 to fold inwardly and be inverted, with the top surface of the table top resting against the top of the mattress 18 and the outer leg member 26 collapsing inwardly so that it is generally parallel to the table top when this top is resting on the surface of the mattress. A strap 29 extending from the underside of one table 12 connects to a pin 31 on the other table to hold the tables in the folded position shown in FIG. 6. Note, that in the extended position the leg member 28 is offset at an acute angle outwardly from the side of the support 14. This is desirable in order to allow bed sheets to be placed on and removed from the mattress 18 without undue interference from the extended tables 12.

OPERATION

The wall bed and collapsible table combination of this invention is easy to operate. Initially, the wall bed is pulled from the wall cavity 20 with the tables 12 being in the position shown in FIG. 6. The user would simply grasp the table top 24 and pull it outwardly from the bed 10, unfolding it about the hinge 46 so that the table top moves from the folded position to a partially extended position shown in solid lines in FIG. 8. At the same time, the user would grasp the outer leg member 26, pulling it outwardly from the underside of the table to open the brace 40. This moves the leg member 26 so that it is generally at a right angle with respect to the table top 24. The user pushes the brace 40 outwardly, securing it, and then moves the table 12 so that the bottom of leg member 26 rests on the floor on which the bed 10 rests. The hinge 54 connecting the inner leg member 28 to the support 14 is moved to a fully open position as shown in FIG. 4 so that the leg member 28 is slightly offset and at an angle with the sides of the boxsprings 16 and mattress 18. The hinge 54 provides support and secures the leg member 28 to the support.

When it is desired to retract the bed 10, the user simply pushes the brace 40 inwardly, folds the leg member 26 inwardly about the hinge 32 while simultaneously inverting the table top 24 about the hinge 46 so that the top side of the table top 24 rests on the surface of the mattress 18. Next the inner leg member 28 is moved from an angular position into a generally parallel position with respect to the side of the mattress 18. The leg member 26 is folded inwardly, resting against the underside of the table top. With both tables 12 in the position shown in FIG. 6, the bed 10 may be moved to its retracted position in the wall.

SCOPE OF THE INVENTION

The above description presents the best mode contemplated of carrying out the present invention as depicted in the preferred embodiment. The combination of features illustrated by this embodiment provide the convenience of this invention. This invention is, however, susceptible to modifications and alternate constructions from the embodiment shown in the drawing and described above. Consequently, it is not the intention to limit it to the particular embodiment disclosed. On the contrary, the intention is to cover all modifications and alternate constructions falling within the scope of the invention as generally expressed by the following claims.

I claim:

1. A wall bed of the type having a support for holding a mattress and means for mounting the support to a wall to enable the support with the mattress thereon to be retracted into the wall, comprising a collapsible side table mounted to the support and movable between a folded storage position enabling the table to be retracted into the wall with the support and an extended position where the table is positioned next to the support, said side table having a table top with first and second leg member attached by hinge means to opposite ends of the table top, and said first leg member extending downwardly to a floor on which the support rests and said second leg member being attached by hinge means to the support.

2. The wall bed of claim 1 wherein there is a foldable brace connected between the underside of the table top and the first leg member.

3. The wall bed of claim 1 wherein the second leg member is offset at an acute angle outwardly from the support.

4. The wall bed of claim 1 where there are a pair of collapsible tables mounted to the support on opposite sides thereof.

5. The wall bed of claim 1 where the top side of the table top rests against the mattress when the table is in the folded storage position.

6. A wall bed comprising a support for a mattress which is adapted to be retracted inwardly into a wall cavity, said support having a side which extends outwardly from the wall cavity when the wall bed is pulled from said cavity, a collapsible side table mounted to the support and movable between a folded storage position enabling the table to be retracted into the wall cavity with the support and an extended position where the table is positioned next to the support, said table having a table top which in the retracted position rests on the top of the mattress and in the extended position is adjacent said side of the support, and said table top having a pair of leg members hingedly mounted to opposed ends of the table top, with one leg member adapted to rest on a floor supporting the support and the other leg member hingedly mounted to the support.

* * * * *